US005888020A

United States Patent [19]

Brais et al.

[11] Patent Number: 5,888,020

[45] Date of Patent: Mar. 30, 1999

[54] SUB-TIDAL PLATFORM

[76] Inventors: Joseph E. Brais; David T. Brais, both of 36 Carolyn Dr., West Warwick, R.I. 02893

[21] Appl. No.: 916,702

[22] Filed: Aug. 21, 1997

[51] Int. Cl.[6] ..... E02B 3/04; E02B 3/12

[52] U.S. Cl. ..... 405/28; 256/12.5; 405/21; 405/31; 405/34

[58] Field of Search ..... 405/21, 15, 27–35; 256/12.5; 244/114 B

[56] References Cited

U.S. PATENT DOCUMENTS

| | | | |
|---|---|---|---|
| 226,772 | 4/1880 | Mueller . | |
| 604,810 | 5/1898 | Waddell . | |
| 762,727 | 6/1904 | Landenberger, Jr. . | |
| 1,574,153 | 2/1926 | Kellner . | |
| 2,655,790 | 10/1953 | Daley . | |
| 2,710,505 | 6/1955 | Magill . | |
| 2,827,769 | 3/1958 | Hunter | 405/33 |
| 3,011,316 | 12/1961 | Wilson . | |
| 3,214,916 | 11/1965 | Martin . | |
| 3,222,870 | 12/1965 | Miller et al. . | |
| 3,309,876 | 3/1967 | Potter . | |
| 3,844,125 | 10/1974 | Williams | 405/33 |
| 3,966,172 | 6/1976 | Garrett . | |
| 4,089,179 | 5/1978 | Trautman . | |
| 4,129,006 | 12/1978 | Payne | 405/31 |
| 4,279,536 | 7/1981 | Jarlan . | |
| 4,367,978 | 1/1983 | Schaaf et al. . | |
| 4,647,249 | 3/1987 | Grooms . | |
| 4,671,495 | 6/1987 | Garland et al. . | |
| 4,900,188 | 2/1990 | Haselton et al. . | |
| 5,224,794 | 7/1993 | Atkinson et al. . | |
| 5,509,755 | 4/1996 | Olsen et al. | 405/21 |

FOREIGN PATENT DOCUMENTS

| | | | |
|---|---|---|---|
| 693310 | 8/1964 | Canada | 405/28 |

OTHER PUBLICATIONS

"Bring Back the Beach, with Beachsaver Reefs" –brochure Breakwaters International Inc.

*Primary Examiner*—Dennis L. Taylor
*Attorney, Agent, or Firm*—Salter & Michaelson

[57] ABSTRACT

A sub-tidal platform adapted to be placed under water in front of a beach comprises a support structure having at least two upwardly extending, spaced-apart side walls extending along vertical planes. Each side wall has a bottom adapted to rest on a generally horizontal surface, and a sloping, upwardly extending edge which is at an acute angle with respect to the bottom. A plurality of interconnecting members extend between the side walls for maintaining them in an upright position. The interconnecting members are positioned adjacent to the sloping edge of the side walls. A plurality of gates are pivotally connected to the interconnecting members of the support structure for controlling fluid flow through the space between the side walls. The gates open in response to incoming fluid flow through the gates, and close in response to outgoing fluid flow in the opposite direction. The gates, when in their closed position, combine to form a sloping wall which substantially blocks the flow of fluid through the space between the side walls, and deposits fluid-carried material in the space formed by the side walls and sloped wall.

8 Claims, 5 Drawing Sheets

SUB-TIDAL PLATFORM

BACKGROUND AND SUMMARY OF THE INVENTION

This invention relates generally to apparatuses and constructions used to produce material deposits in response to fluid flow, and more particularly to a beach erosion control system embodying a sub-tidal platform which is adapted to be positioned on- or offshore from a beach to be protected.

Apparatuses for preventing erosion of beaches, the bottoms and/or banks of rivers or streams, and/or for producing material deposits under water, are well-known in the art. For example, U.S. Pat. No. 226,772 to Mueller discloses a rectangular-shaped, jetty-shutter assembly comprising a vertical wall with hinged gates or slats mounted at their upper ends on horizontal axes on a beach side of the wall. The gates open toward the beach in response to incoming waves or current, and close in response to outgoing waves or current, to deposit sediment on the beach side of the wall between the wall and the beach. The assembly is supported in the water by vertically driven piles.

U.S. Pat. No. 604,810 to Waddell discloses a jetty assembly for deepening a flowing channel. The assembly comprises two rows of interconnected vertical piles inclined outwardly from the shore of the channel to the center thereof. Gates, which are hinged at their tops on horizontal axes, are mounted on one row of the piles so that incoming tide or current can flow through the gates, while outgoing tide or current is obstructed from the outward flow. Thus, a rapid outgoing tide or current is produced on the opposite side of the channel to deepen the channel.

U.S. Pat. No. 1,574,153 to Kellner discloses a jetty of A-frame-type triangular construction for preventing river bank erosion and silt accumulation. Each side and bottom of the triangular jetty includes a plurality of longitudinally extending cables which extend between and from opposite ends thereof. In use, an inner end of one jetty section is located at a 45 degree angle to the river bank and anchored to the bank by the extending cable portions at that end. Additional jetty sections may be interconnected by the extending cable portions at their adjacent ends. In operation, the cable portions defining the sides and bottom of the jetty permit water flow through the jetty sections with deposition of silt occurring on the downstream side of the sections.

U.S. Pat. No. 2,655,790 to Daley discloses a vertical permeable barrier wall formed in sections and mounted on a horizontal platform. The wall includes a series of flexible vanes fixed at their lower ends on horizontal axes and free to flex in either direction in response to wave or current flow, so that water flows through the wall in both directions upwardly to reduce the water's velocity, causing it to drop sediment at the base of the wall on both sides thereof.

U.S. Pat. No. 3,011,316 to Wilson discloses a breakwater having a pair of spaced-apart fences each with a plurality vanes hingedly connected between posts so that they extend along horizontal axes. The purpose of Wilson's breakwater is to dissipate waves along the shores of bodies of water where the waves have a normal tendency to wash away the beach. The vanes are provided for dissipating waves travelling towards the beach.

U.S. Pat. No. 3,214,916 to Martin, as with the aforementioned Mueller patent, discloses a vertical wall assembly with gates hinged at their upper ends on horizontal axes on a beach side of the wall. The gates open toward the beach in response to incoming waves or current, and close in response to outgoing waves or current, to cause deposition of sediment between the wall and the beach. The wall is mounted on embedded posts and each gate carries a pivoted locking bar which embeds in accumulated deposits as they build up adjacent the bottom of the gate, thereby preventing the gate from thereafter opening in response to incoming waves or current and washing away the accumulated deposits.

U.S. Pat. No. 3,966,172 to Garrett discloses a movable fence which is used in protecting areas against wind-blown snow, sand, or the like. As shown in Garret, the fence is triangularly-shaped, and has a plurality of pliant, deformable or resilient strips mounted upon a plurality of A-frame members.

U.S. Pat. No. 4,367,978 to Schaaf et al. discloses a string of prism-shaped modules of triangular cross section and essentially solid construction. Each module has an upper converging passage extending through it from the ocean side to the beach side, so that waves or current flowing through the passage are dissipated in energy. An intermediate passage converges in the same manner and may have a planar flexible gate (valve member) mounted across its beach side opening so that the gate permits incoming wave or current flow through the passage, but blocks outgoing wave or current flow, so that sediment is deposited at the base of the module. In addition, a third lowermost passage is provided with an open bottom to facilitate self-implementation of the module on the ocean floor.

U.S. Pat. No. 4,647,249 to Grooms further discloses an inverted T-shaped member which has a horizontal base and a vertical wall with one-way flexibility. The vertical wall flexes in response to an incoming wave and then returns to a vertical position to impede outward water flow so that sediment settles out on the beach side of the wall.

A disadvantage germane to each of the foregoing systems is that they are expensive to build and are oftentimes subject to failing after a period of time due to the stress of the flow of water therethrough. Also, they tend to starve sand from their downward drive thereby negatively impacting the environmental sanctity of the marine life between the systems and the beaches which they protect.

In general, the present invention is directed to a sub-tidal platform adapted to be placed under water in front of a beach. The platform comprises a support structure having at least two upwardly extending, spaced-apart side walls extending along vertical planes. Each side wall has a bottom adapted to rest on a generally horizontal surface, and a sloping, upwardly extending edge which is at an acute angle with respect to the bottom. A plurality of interconnecting members extend between the side walls for maintaining them in an upright position. The interconnecting members are positioned adjacent to the sloping edge of the side walls. A plurality of gates are pivotally connected to the interconnecting members of the support structure for controlling fluid flow through the space between the side walls. The gates open in response to incoming fluid flow through the gates, and close in response to outgoing fluid flow in the opposite direction. The gates, when in their closed position, combine to form a sloping wall which substantially blocks the flow of fluid through the space between the side walls, and deposits fluid-carried material in the space formed by the side walls and sloped wall.

Accordingly, among the several objects of the present invention are the provision of a sub-tidal platform which is capable of preventing the erosion of a beach in front of which it is placed by causing the natural, slow build-up of material between the sub-tidal platform and the beach; the provision of such a sub-tidal platform which is fabricated from light-weight materials so as to make its implementation easy; the provision of such a sub-tidal platform which is further fabricated from non-corroding materials which extend the life thereof; the provision of such a sub-tidal platform which, over an extended period of time, actually increases the amount of deposit material forming the beach; the provision of such a sub-tidal platform which does not immediately (and negatively) impact the ecology of the beach thereby harming marine life; the provision of such a sub-tidal platform which can easily be removed if necessary; and the provision of such a sub-tidal platform which is relatively simple in construction, cost-efficient to manufacture, and easy to assemble.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
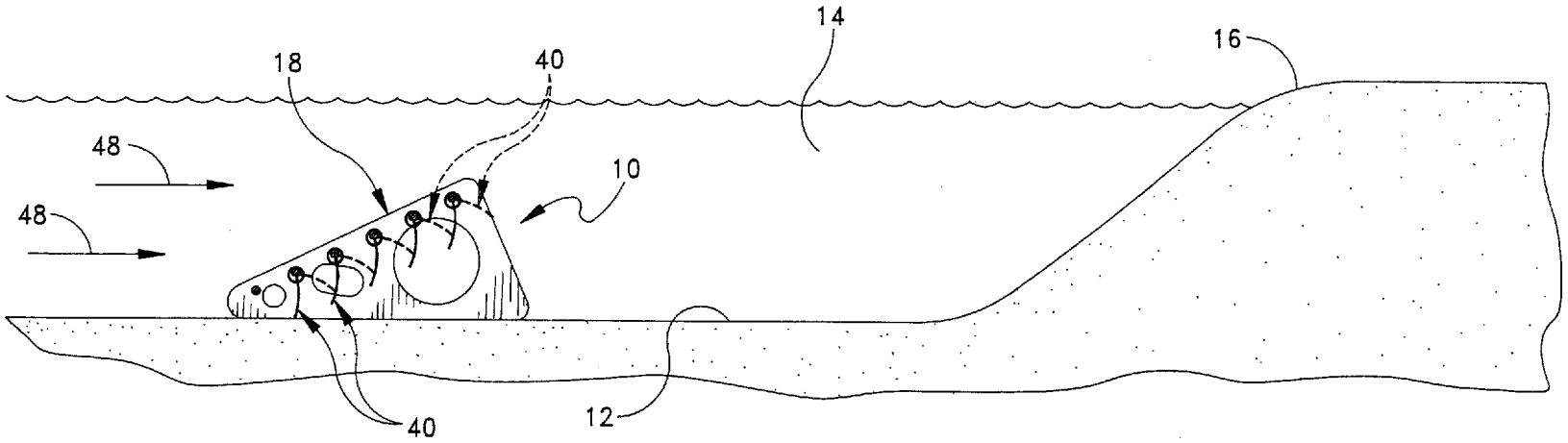
FIG. 1 is a side elevational view of a sub-tidal platform of the present invention positioned in front of a beach under water.
Figure 2:
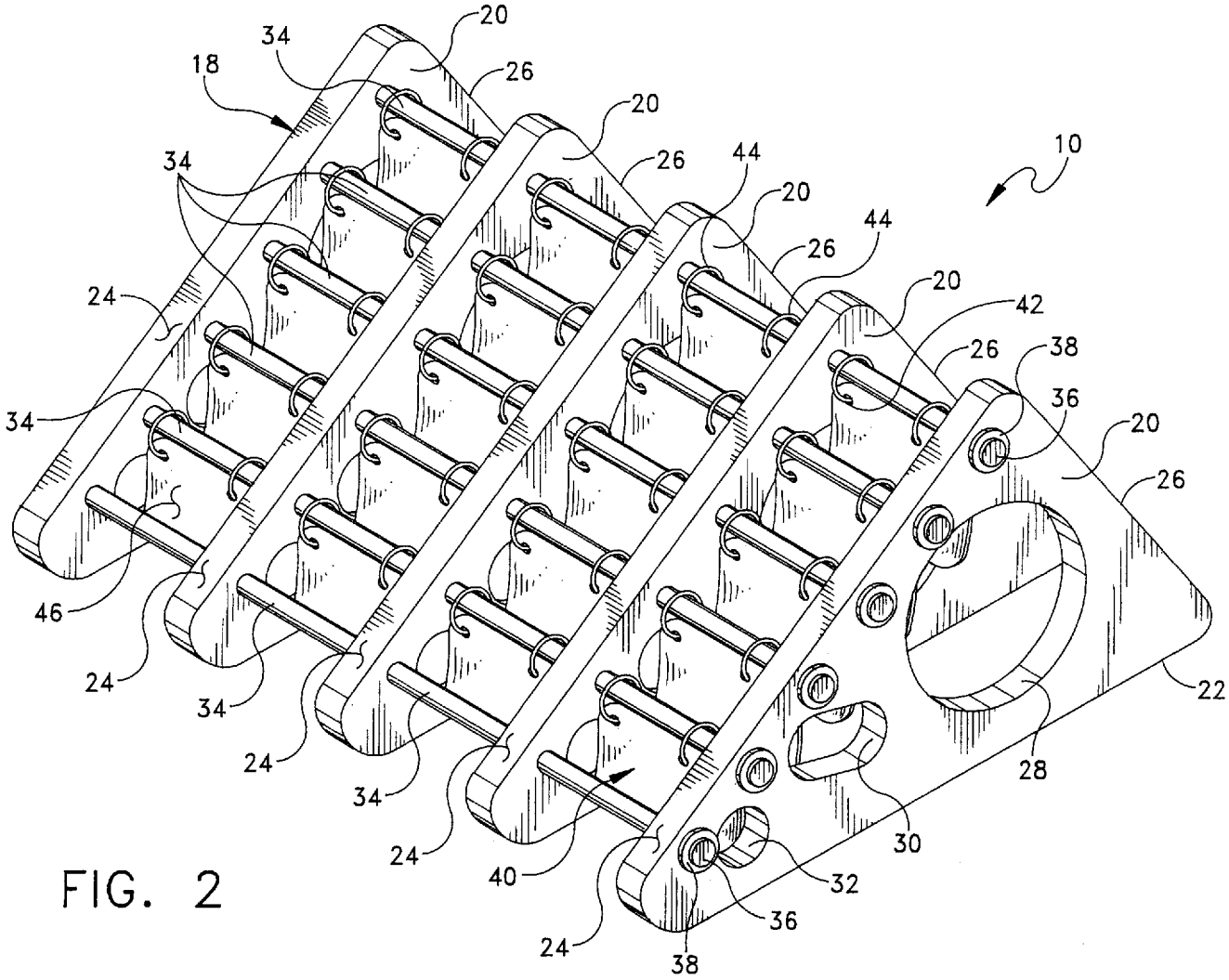
FIG. 2 is a perspective view of the sub-tidal platform illustrated in FIG. 1.
Figure 3:
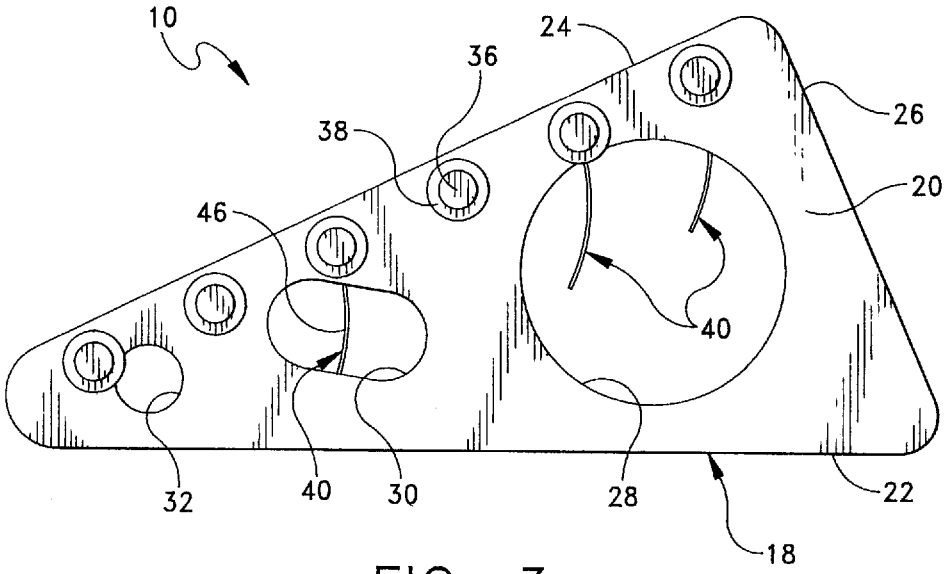
FIG. 3 is a side elevational view thereof.

Referring now to the drawings, and more particularly to FIG. 1, there is generally indicated at 10 a sub-tidal platform of the present invention. As illustrated in FIG. 1, the platform 10 is being used as a beach erosion control system which is adapted to be positioned on a bottom 12 of a body of water 14 (e.g., lake or ocean) offshore from a beach 16 to be protected or restored. The platform 10 is designed so that after a period of time, material is deposited within the platform so that the contour of the bottom 12 of the body of water 14 is raised, thus preventing erosion of the bottom and subsequently the beach 16. It should be understood that depending upon the length of the beach 16 to be protected, any number of platforms 10 can be employed offshore in front of the beach. Moreover, the platforms 10 can be strategically placed either in-line, or at angles with respect to one another for more effectively protecting the beach 16.

Referring to FIGS. 2–6, the sub-tidal platform 10 comprises a support structure generally indicated at 18 having a plurality of upwardly extending, spaced-apart side walls 20, each extending along generally vertical planes. As shown throughout the drawings, there are five such side walls 20, and it should be understood that the platform 10 can have any number of side walls and still fall within the scope of the present invention. Each side wall 20 is triangularly-shaped, and has a bottom surface 22 which is adapted to rest on the bottom 12 or floor of the body of water 14, a first sloping, upwardly extending surface 24 (or edge) which is at an acute angle with respect to the bottom surface 22 (e.g., thirty degrees), and a second sloping, downwardly extending surface 26 which is at a right angle with respect to the first sloping surface 24 and at an acute angle (e.g., sixty degrees) with respect to the bottom surface 22. Preferably, the side walls 20, and the entire platform 10 for that matter, is fabricated from light-weight, rigid thermoplastic composite material which is suitably reinforced by resin fiber (e.g., fiberglass). Each side wall 20 is identically constructed to have several openings 28, 30 and 32 formed therein for reducing its weight and for allowing water to pass therethrough thereby reducing the stresses caused by water flow after it is employed.

The support structure 18 further includes a plurality of horizontally disposed interconnecting members, each indicated at 34, which extend between the side walls 20 for maintaining them in an upright and stable position. As shown, there are six such interconnecting members 34, and accordingly, there can be any number of members for securing the side walls 20 to one another. Each interconnecting member 34 extends through aligned openings (not shown) formed in the side walls 20. These openings are sized to receive the interconnecting members 34 snugly therethrough whereupon the interconnecting members can be permanently attached to the side walls 20 by any suitable means (e.g., heat or chemical treating). End caps 36 are provided at the outer ends of each interconnecting member 34 for securing the assembly together. Each end cap 36 has a circumferential flange 38 which engages its respective side wall 20 for substantially preventing racking of the support structure 18. As shown, each interconnecting member 34 is positioned adjacent to the first sloping surface 24 of the side walls 20 so that they form a step-like arrangement.

Figure 4:
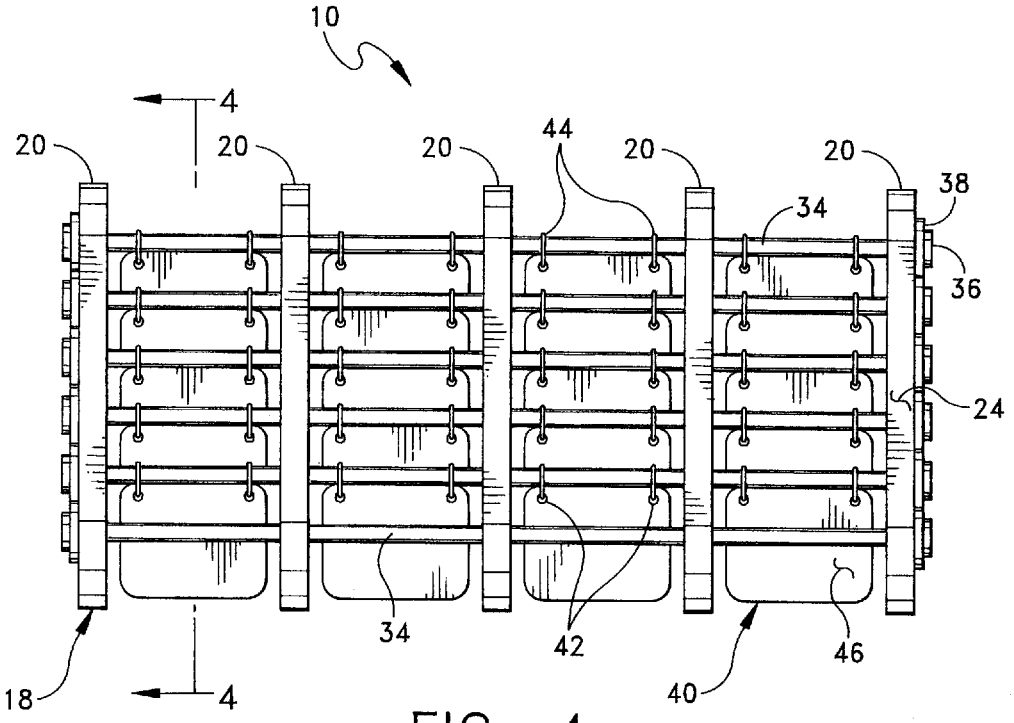
FIG. 4 is a front elevational view thereof.
Figure 5:
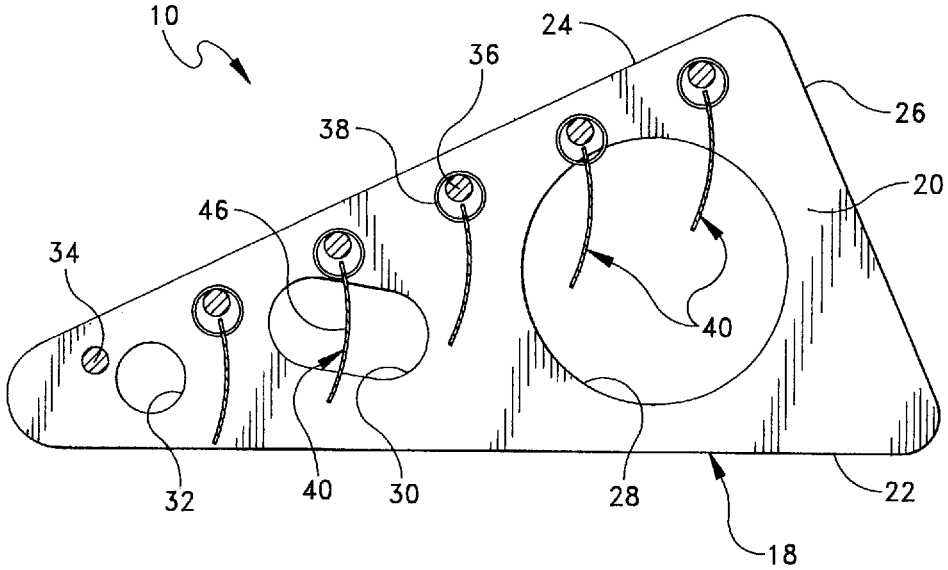
FIG. 5 is a cross-sectional view taken along lines 5—5 of FIG. 4 illustrating gates of the sub-tidal platform in an open position.
Figure 6:
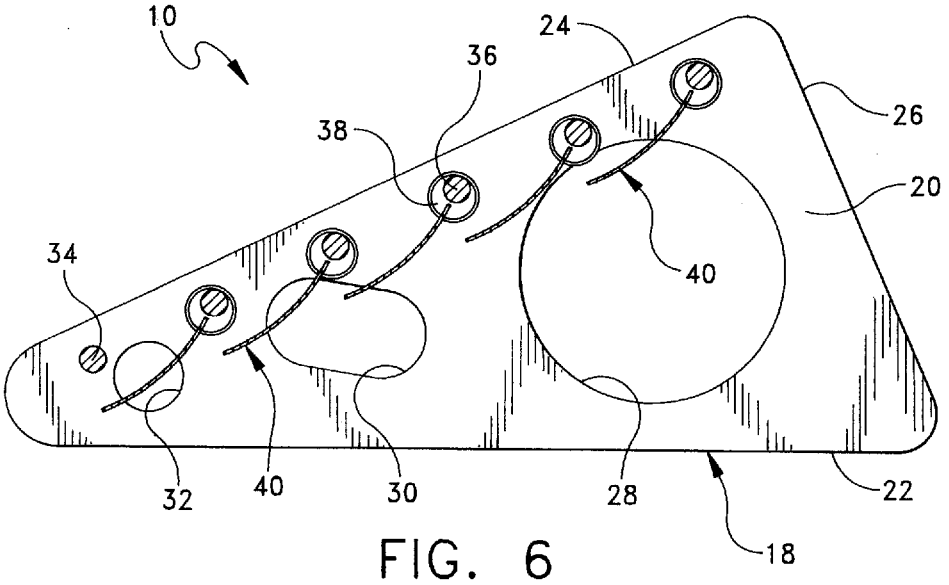
FIG. 6 is a cross-sectional view similar to FIG. 5 illustrating the gates in a closed position.

Each interconnecting member 34, between adjacent side walls 20, receives a gate, each generally indicated at 40, which is pivotally connected to the interconnecting member 34 of the support structure 18 for controlling the fluid flow through the space between the side walls 20. As illustrated best in FIGS. 4–6, the gates 40 are arranged in rows and columns, each gate being movable between an open position when the flow of incoming fluid flows therethrough (see FIG. 5), and a closed position when the outgoing fluid flows in the opposite direction (see FIG. 6). The arrangement is such that when the gates 40 are in their closed position, they form a sloping wall which substantially blocks the flow of fluid through the spaces between the side walls 20 and deposits fluid-carried material (e.g., sand) in the space formed by the side walls and the sloped wall created by the closed gates 40. FIG. 4 illustrates the front of the platform 10 and, even though the gates 40 are in their open position, it is evident that they are arranged in such a manner that they form a sloping wall when in their closed position for blocking the flow of fluid therethrough during the outgoing tide, for example.

Each gate 40 has a pair of openings 42 formed along their upper edge margins, each opening receiving therein a support ring 44 which attaches the gate 40 to its respective interconnecting member 34 for swingably mounting the gate thereto. As shown, two support rings 44 swingably attach each gate 40 to its respective interconnecting member 34. Each gate 40 is of sufficient length so that its bottom edge margin engages the interconnecting member 34 located immediately below the interconnecting member upon which the gate is hingedly attached for stopping the movement of the gate at its closed position. As illustrated best in FIGS. 3, 5 and 6, each gate 40 is curved so that its concave surface 46 faces the flow of incoming water towards the beach. The concave nature of the gate 40 increases the amount of surface area of the gate 40 thereby lessening the amount of force required to move it backwards for allowing maximum flow of fluid through the platform 10.

Preferably, the support structure 18 and gates 40 are assembled onshore before they are implemented offshore in front of the beach 16 under water. The sub-tidal platform 10 may be installed by placing it on inflatable pontoons or rafts (not shown), and then floated at high tide to the desired position in which the platform 10 is to be located. By progressively deflating the pontoons or rafts from one end of the platform 10 to the other, the platform then can be submerged into position. During the submersion of the platform 10, the open configuration of the platform facilitates in its submersion. It should be noted that the platform 10 preferably has a negative buoyancy so that it sinks when placed in the body of water 14. The open configuration of the platform 10 is advantageous in that it has a minimum impact on biological life when placed on the bottom 12 of the body of water 14.

After the sub-tidal platform 10 has been located in the desired position on the bottom 12 of the body of water 14, the platform 10 can be held in place by a plurality of sand bags (not shown), for example. More particularly, sand bags can be positioned against the side walls 20 of the support structure 18 in such a manner that they engage the side walls, and extend through the openings 28, 30 and 32 formed in the side walls to provide initial anchoring of the platform 10 on the bottom 12 of the body of water 14. Additional platforms 10 may then be located in the same manner in end-to-end relationship along a line essentially parallelling the beach 16, or at an angle thereto if desired, and connected together by any suitable means. Preferably, the platforms 10 are located offshore a distance on the order of 100 to 300 yards, depending upon specific conditions. The platforms 10 can also be anchored or secured by suitable anchors (e.g., Danforth anchors) which engage the support structure 18 and are embedded in the bottom 12 of the body of water 14 via a hole drilled therein.

Figure 7:
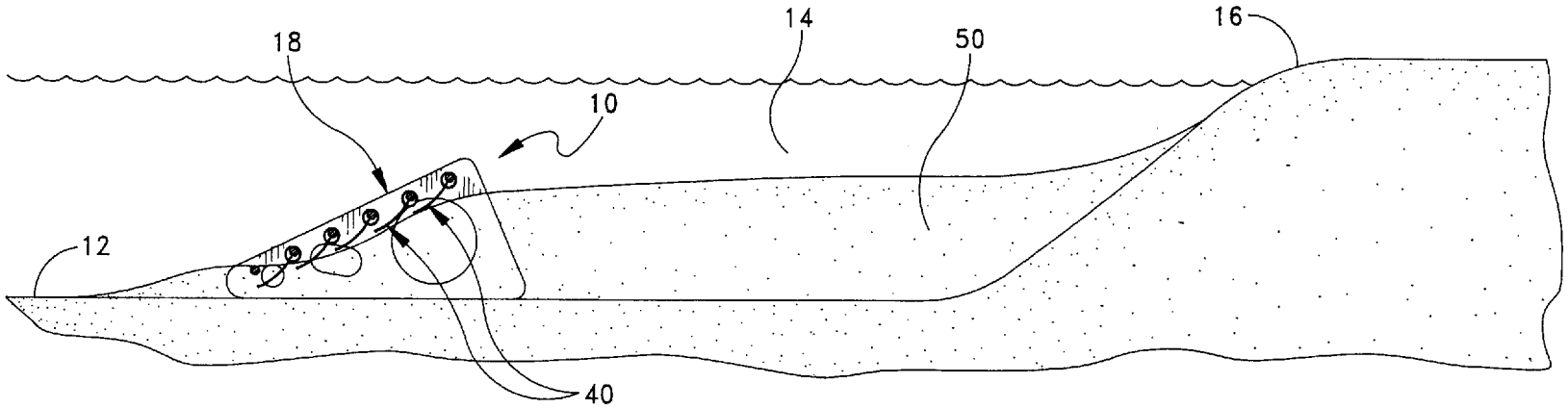
FIG. 7 is a side elevational view of the sub-tidal platform illustrated in FIG. 1 showing the sub-tidal platform after a period of time wherein it is partially covered with deposit material, e.g., sand.
Figure 8:
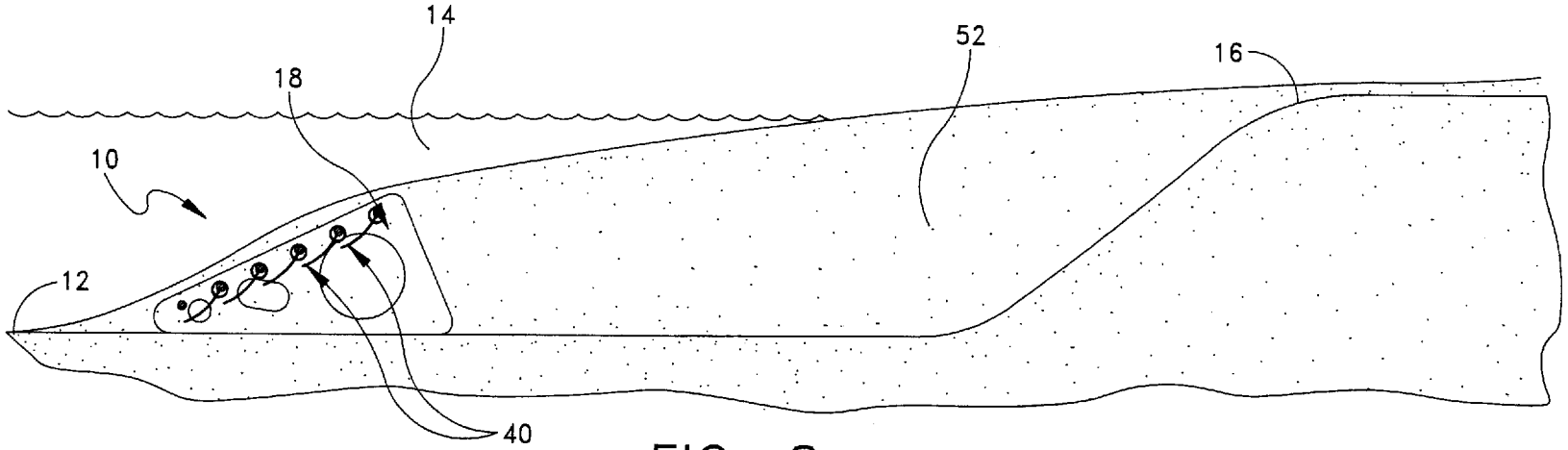
FIG. 8 is a side elevational view of the sub-tidal tidal platform illustrated in FIGS. 1 and 7 showing the sub-tidal tidal platform after an even further period of time wherein it is completely covered with deposit material.

Referring now to FIGS. 1, 7 and 8, after each sub-tidal platform 10 is initially implanted on the bottom 12 of the body of water 14, during incoming water flow in the form of current, incoming tide, and/or incoming waves toward the beach 16, as indicated by arrows 48, the gates 40 of the platform 10 pivot counterclockwise as viewed in FIG. 1 and illustrated in broken lines therein. This permits water to flow through the gates 40 and the side walls 20 with some suspended material in the water, such as sand sediment, depositing inside the support structure 18 onto the sandbags to form an initial layer of sand sediment as a result of a decrease in the velocity of water by the gates 40.

With reference to FIG. 7, during outward water flow in the form of current, outgoing tide, and/or receding waves, the outgoing water causes the gates 40 to pivot clockwise to their closed position. This substantially prevents water from flowing through the platform 10. As a result, the sand sediment, after a period of time, deposits inside the platform 10 onto the previously deposited sediment as well as further inward towards the beach 16 in the area between the beach and the platform 10, thereby eventually causing a build-up of sand deposit in the platform 10 and along the beach between the platform and the beach. This build-up of deposit material is indicated by reference numeral 50.

As the above-described sand deposition occurs, the sand build-up also begins to progressively deposit against the gates 40 to retain the gates in their closed position so that upon subsequent incoming water flow, the deposited sand is not washed away from inside the sub-tidal platform 10. This procedure continues upon subsequent incoming and outgoing water flow movement, with the sand continuing to build-up within the platform 10 and the area between the beach 16 and the platform, as illustrated by reference numeral 52 in FIG. 8, with the gates 40 becoming progressively closed to prevent washing away of the deposited sand. This sand build-up then progressively continues until the top of the platform 10 has become essentially covered. Thereafter, even though the beach 16 is again eroded as a result of a violent storm, for example, assuming the platform 10 remains in place, the beach will again be restored in the same manner. On the other hand, if the platform 10 is damaged or washed away, upon repair or replacement thereof, the beach 16 will again be restored. Further, at the beginning of, or during, the beach restoration process, additional sand may be introduced at the beach sore line, or between the shore line and the platform 10, by manual deposition or pumping, to enhance the beach restoration process.

It should be noted that in addition to being positioned under water for restoring or rebuilding the beach 16, the platform 10 can be used for other purposes as well. For example, the platform 10 can be positioned on dry land for restoring or forming a sand dune. Under such use, the platform 10 functions in response to the wind blowing through the hinged gates 40 to cause a reduced wind velocity inside the platform 10 and the deposition of air-borne material, such as sand, inside the platform and downwind thereof. Ultimately, sand will build-up inside and outside the platform 10 to essentially cover the platform and produce the sand dune.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sub-tidal platform adapted to be placed under water in front of a beach comprising:

a support structure comprising at least two upwardly extending, spaced-apart side walls extending along vertical planes, each said side wall having a bottom adapted to rest on a generally horizontal surface, and a sloping, upwardly extending edge which is at an acute angle with respect to said bottom, and a plurality of interconnecting members which extend between said side walls for maintaining them in an upright position, said interconnecting members being positioned adjacent to said sloping edge of said side walls; and a plurality of gates pivotally connected to said interconnecting members of the support structure for controlling fluid flow through the space between said side walls, said gates opening in response to incoming fluid flow through the gates, and closing in response to outgoing fluid flow in the opposite direction, said gates, when in their closed position, forming a sloping wall which blocks the flow of fluid through the space between the side walls and deposits fluid-carried material in the space formed by the side walls and sloped wall.

2. A sub-tidal platform as set forth in claim 1, said support structure comprising at least one other identically constructed side wall in spaced, side-by-side relation with respect said side walls, said interconnecting members extending between each side wall for interconnecting them.

3. A sub-tidal platform as set forth in claim 1, each interconnecting member between said side walls supporting a gate for swinging movement between their open and closed positions.

4. A sub-tidal platform as set forth in claim 3, each gate being of sufficient length so that its bottom edge margin engages the interconnecting member located immediately below the interconnecting member upon which the gate is hingedly attached for stopping the gate at its closed position.

5. A sub-tidal platform as set forth in claim 4, each gate being curved and supported by said interconnecting member in such a manner that its concave surface faces the incoming flow of water towards the beach.

6. A sub-tidal platform as set forth in claim 1, said acute angle between the bottom and sloping edge of each wall being approximately thirty degrees.

7. A sub-tidal platform as set forth in claim 1, said sub-tidal platform being fabricated from light-weight, rigid thermoplastic composite material.

8. A sub-tidal platform as set forth in claim 7, said composite material being reinforced by a resin fiber.

* * * * *